US005078101A

United States Patent [19]

Anderson et al.

[11] Patent Number: 5,078,101

[45] Date of Patent: Jan. 7, 1992

[54] MARINE PROPULSION DEVICE INTERNAL COMBUSTION ENGINE

[75] Inventors: Philip A. Anderson, Waukegan; William A. Bernau, Lindenhurst, both of Ohio; Paul W. Breckenfeld, Kenosha, Wis.; George L. Broughton, Zion, Ill.

[73] Assignee: Outboard Marine Corporation, Waukegan, Ill.

[21] Appl. No.: 479,945

[22] Filed: Feb. 14, 1990

Related U.S. Application Data

[63] Continuation-in-part of Ser. No. 316,329, Feb. 27, 1989.

[51] Int. Cl.[5] ..... F01P 1/06

[52] U.S. Cl. ..... 123/41.31; 123/149 D; 123/195 C; 440/85

[58] Field of Search ..... 123/91.1, 41.31, 195 C, 123/196 CP, 196 W, 198 E, 198 P, 41.86; 440/76, 77, 85; 310/52, 54, 57

[56] References Cited

U.S. PATENT DOCUMENTS

| | | | |
|---|---|---|---|
| 2,086,442 | 7/1937 | Rushmore | 123/41.1 |
| 3,828,754 | 8/1974 | Carlsson | 123/149 D |
| 3,846,980 | 11/1974 | DePalma | 123/572 |
| 3,947,710 | 3/1976 | Miyamoto | 123/149 D |
| 4,146,806 | 3/1979 | Katsumata | 123/149 D |
| 4,500,772 | 2/1985 | Ahner et al. | 310/57 |
| 4,739,204 | 4/1988 | Kitamura et al. | 123/41.31 |

FOREIGN PATENT DOCUMENTS

| | | | |
|---|---|---|---|
| 654823 | 12/1962 | Canada | 440/85 |
| 158580 | 12/1939 | Fed. Rep. of Germany | 123/149 D |

*Primary Examiner*—Noah P. Kamen

*Attorney, Agent, or Firm*—Michael, Best & Friedrich

[57] ABSTRACT

An internal combustion engine comprising an engine block including an outer surface, structure including the engine block and a member connected to the surface of the engine block for defining a substantially closed chamber, a crankshaft extending from the engine block and into the chamber, a flywheel located in the chamber, connected to the crankshaft, and including thereon a starter gear, a stator located in the chamber and fixed to the engine block, a magnet or magnets located in the chamber and fixed to the flywheel for rotation therewith in a path adjacent to the stator, a finned coolant jacket located in the chamber and adapted to be connected to a source of coolant exterior to the chamber, structure on the flywheel for creating air flow in a path extending between the stator and the coolant jacket, a starter motor mounted on the block exteriorly of the chamber and including an output shaft extending into the chamber through the member, and a mechanism locatd in the chamber, drivingly connected to the output shaft, and engageable with the starter gear in response to output shaft rotation to rotate the flywheel.

16 Claims, 3 Drawing Sheets

Fig. 1
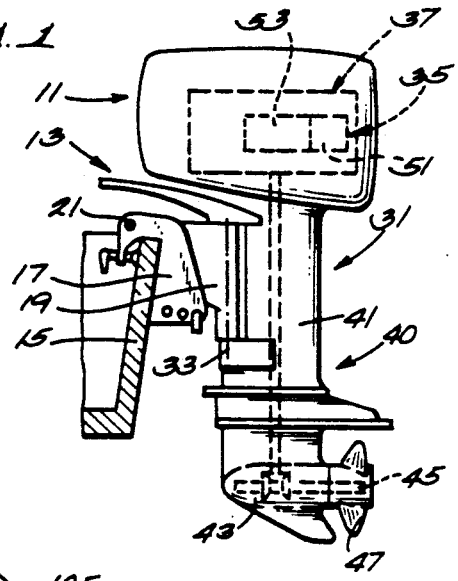
Fig. 4
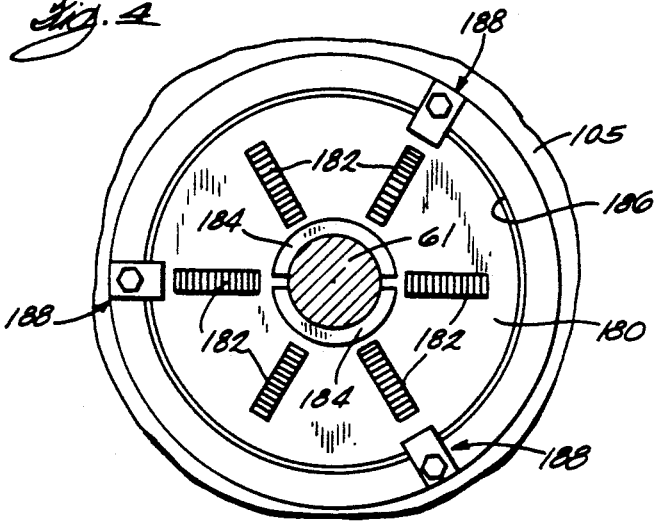
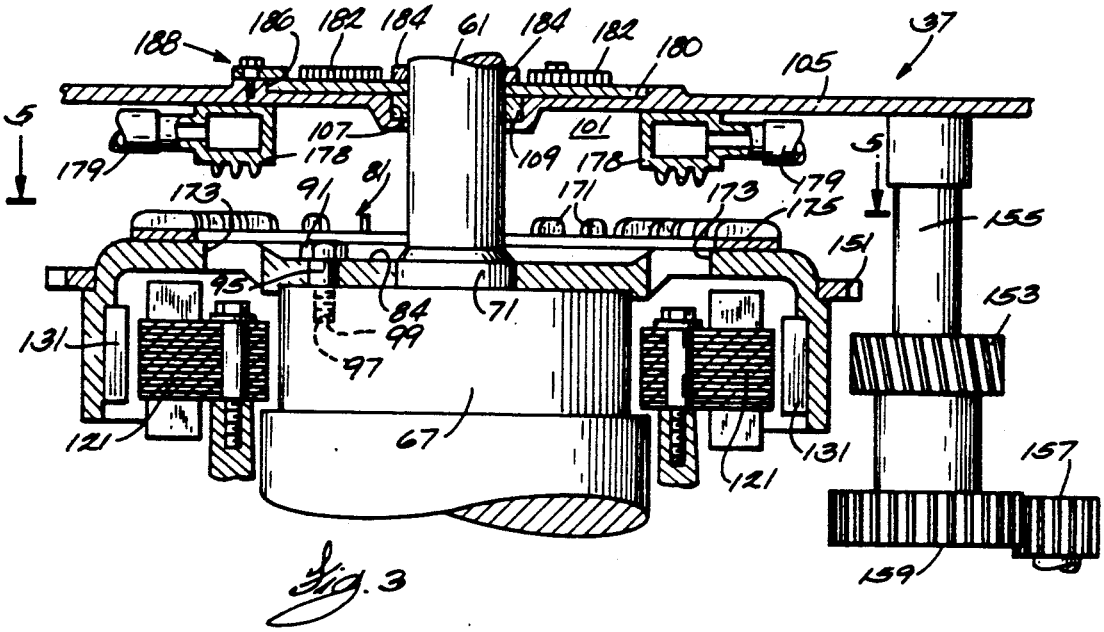
Fig. 3

Fig. 2.
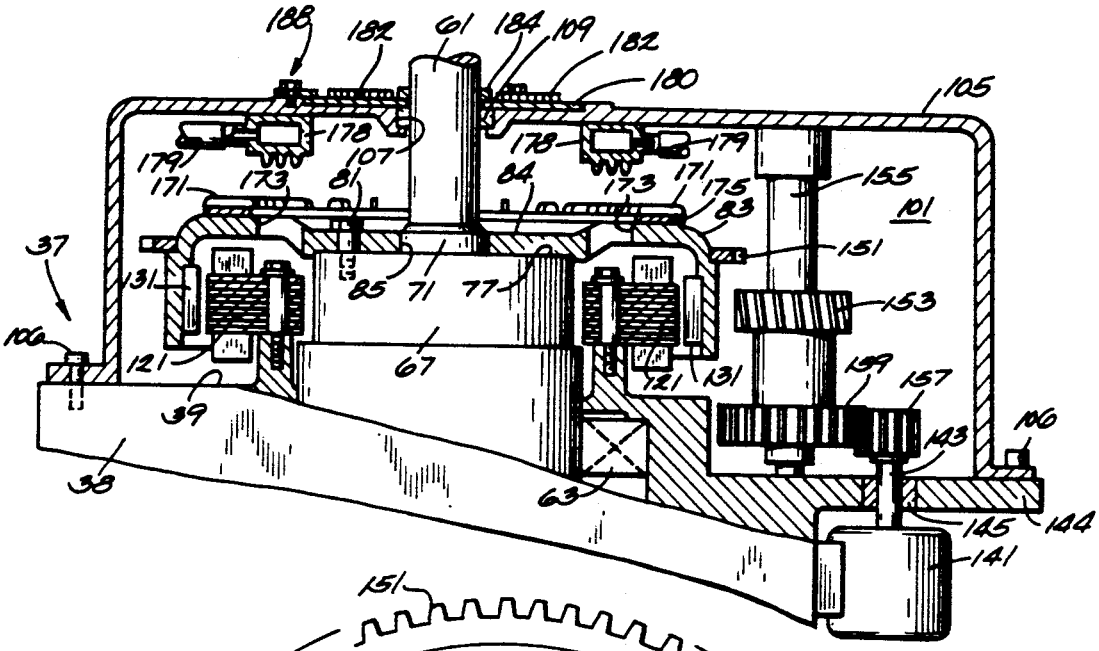
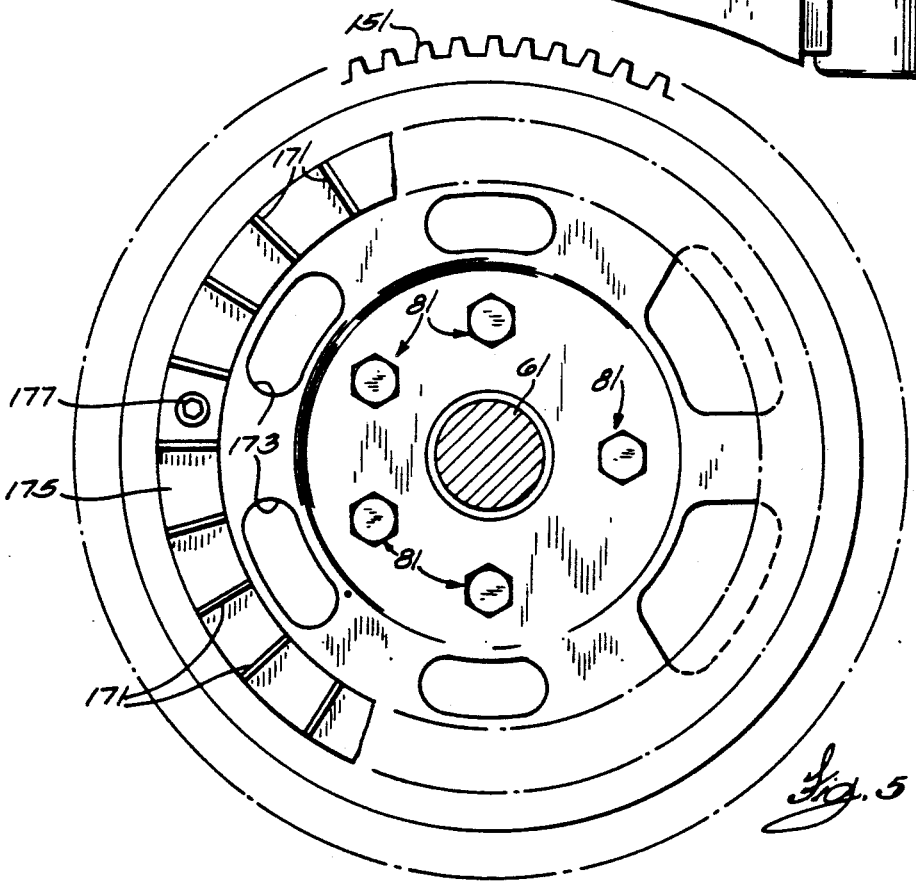
Fig. 5

MARINE PROPULSION DEVICE INTERNAL COMBUSTION ENGINE

RELATED APPLICATION

This is a continuation-in-part of Ser. No. 16,329, filed Feb. 27, 1989.

BACKGROUND OF THE INVENTION

The invention relates generally to outboard motors. More particularly, the invention relates to internal combustion engines included in outboard motors.

In the past, certain relatively expensive outboard motor components have experienced considerable corrosion problems, especially when the outboard motors were used in sea water. The invention hereinafter disclosed is intended to economically overcome this problem.

Attention is directed to the following United States patents.

| | | |
|---|---|---|
| Kiekhaefer | 2,549,483 | April 8, 1949 |
| Davies | 2,676,559 | December 11, 1951 |
| Kiekhaefer | 2,798,471 | September 14, 1955 |
| Iwahashi, et al. | 4,134,370 | January 16, 1979 |
| Walsh | 4,348,194 | September 7, 1982 |
| Tamba, et al. | 4,561,386 | December 31, 1985 |
| Onda, et al. | 4,632,070 | December 30, 1986 |
| Iwai | 4,661,076 | April 28, 1987 |
| Suzuki | 4,721,485 | January 26, 1988 |

SUMMARY OF THE INVENTION

The invention provides an internal combustion engine comprising an engine block, and means on the engine block for defining a substantially sealed chamber.

In one embodiment, the block includes an outer surface, and the means includes a member connected to the outer surface of the engine block.

In one embodiment, the engine further comprises a crankshaft extending from the engine block and into the chamber, and a flywheel located in the chamber and connected to the crankshaft.

In one embodiment of the invention, the engine further comprises means located in the chamber for generating an electrical current.

In one embodiment of the invention, the current generating means includes a stator located in the chamber and fixed to the engine block, and a magnet or magnets supported in the chamber for rotation in a path adjacent to the stator.

In one embodiment of the invention, the engine further comprises means located in the chamber for extracting heat from the chamber.

In one embodiment of the invention, the heat extracting means includes a finned water jacket located in the chamber and adapted to be connected to a source of coolant exterior to the chamber, and means for creating an air flow in a path adjacent the water jacket.

In one embodiment, the means for creating an air flow includes an aperture in the flywheel, and means for creating an air flow through the aperture.

In one embodiment, the means for creating an air flow through the aperture includes a plurality of fins extending from the flywheel.

In one embodiment, the flywheel includes an outer surface extending generally perpendicular to the crankshaft and facing away from the engine block, and the fins are located on the outer surface of the flywheel.

In one embodiment of the invention, the engine further comprises means located in the chamber for starting the engine.

In one embodiment of the invention, the engine further comprises a starter motor mounted on the block exteriorly of the chamber and including an output shaft extending into the chamber through the member, and seal means between the starter output shaft and the member for preventing fluid flow relative to the chamber between the output shaft and the member while affording rotary movement of the output shaft, and the engine starting means includes a starter gear located in the chamber, and a mechanism located in the chamber, drivingly connected to the output shaft and engageable with the starter gear in response to output shaft rotation to rotate the flywheel.

The invention also provides an engine comprising an engine block, means including a first member mounted on the engine block and a second member supported for movement in a path adjacent the first member for generating an electrical potential, a finned coolant heat exchanger supported by the engine block, and means for circulating an air flow heat exchanger between the heat exchanger and the first member.

The invention also provides an internal combustion engine comprising an engine block including an outer surface, means including the engine block and a member connected to the surface of the engine block for defining a chamber, a crankshaft extending from the engine block and into the chamber, a flywheel located in the chamber, connected to the crankshaft, and having thereon a starter gear, a stator located in the chamber and fixed to the engine block, a magnet located in the chamber and fixed to the flywheel for rotation therewith in a path adjacent to the stator, a starter motor mounted on the block exteriorly of the chamber and including an output shaft extending into the chamber and a mechanism located in the chamber, drivingly connected to the output shaft, and engageable with the starter gear in response to output shaft rotation to rotate the flywheel.

The invention also provides an internal combustion engine comprising an engine block, means on the engine block for defining a substantially sealed chamber, and pressure relief means for venting the chamber when the pressure in the chamber exceeds a predetermined value.

The invention also provides an internal combustion engine comprising an engine block at least partially defining a crankcase, a crankshaft extending from the engine block, an outermost bearing rotatably supporting the crankshaft, and sealing means which is located outwardly of the bearing and which surrounds the crankshaft for sealing the crankcase to prevent loss of fluid to the exterior of the engine block.

The invention also provides an internal combustion engine comprising an engine block including an outer surface having thereon an arcuate boss, a crankshaft extending from the engine block, a flywheel connected to the crankshaft, a stator mounted on the boss, and a magnet fixed to the flywheel for rotation therewith in a path adjacent the stator.

Other features and advantages of the invention will become apparent to those skilled in the art upon review of the following detailed description, claims, and drawings.

DESCRIPTION OF THE DRAWINGS

FIG. 1 is a side elevational view of an outboard motor embodying the invention and comprising an engine including a crankshaft and a flywheel.

FIG. 2 is an enlarged elevational view, partially in section, of the engine.

FIG. 3 is a further enlarged, partial view of the engine.

FIG. 4 is a top plan view of the engine.

FIG. 5 is a view taken along line 5—5 in FIG. 3.

Figure 6:
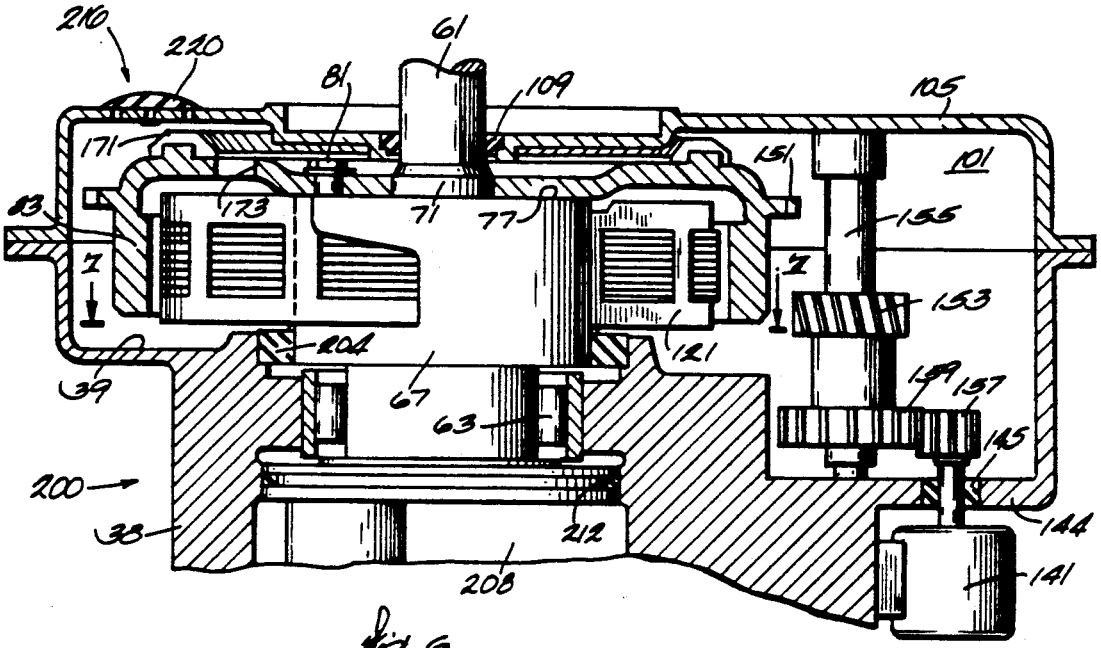
FIG. 6 is a view similar to FIG. 2 showing an alternative embodiment of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in FIGS. 1-5 (see FIG. 1) is an outboard motor 11 comprising a mounting assembly 13 adapted to be connected to a boat transom 15. More specifically, the mounting assembly 13 includes a transom bracket 17 adapted to be fixed to the transom 15, and a swivel bracket 19 pivotally connected to the transom bracket 17 for swinging movement relative thereto about a tilt axis 21 which is generally horizontal when the transom bracket 17 is fixed to the boat transom 15.

The outboard motor 11 also includes a propulsion unit 31 connected to the swivel bracket 19 for pivotal movement in common with the swivel bracket 19 about the tilt axis 21 and for swinging movement relative to the swivel bracket 19 about a steering axis 33 which extends transversely of the tilt axis 21 and which is generally vertical when the propulsion unit 31 is in the normal running position.

The propulsion unit 31 also includes a power head 35 which comprises an internal combustion engine 37 defined, in part, by (see FIG. 2) an engine block 38 having an upper surface 39. The propulsion unit 31 also includes (see FIG. 1) a lower unit 40 including a drive shaft housing 41 which, at its upper end, supports the power head 35 and which, at its lower end, is fixed to a gearcase 43 rotatably supporting a propeller shaft 45 which is driven by the engine 37 and which carries a propeller 47.

The engine block 38 defines one or more cylinders 51 (one shown schematically in FIG. 1) which respectively extend from a like number of one or more crankcases 53 (one shown schematically). In addition, the engine block 38 rotatably supports a crankshaft 61 which is journaled, in part, by bearings 63 (one shown in FIG. 2) supported by the engine block 38, and which includes a first or upper portion 67 extending above the upper surface 39 of the engine block 38. In addition, the crankshaft 61 includes a second or end portion 71 which projects above the first or upper portion 67 and which has a diameter less than the diameter of the first or upper portion 67 so as to define a radially extending shoulder 77 at the upper end of the first or upper portion 67.

Fixed or secured to the crankshaft shoulder 77 by suitable means in the form of one or more bolts 81 is a flywheel 83 having an outer or upper surface 84 extending generally perpendicularly to the crankshaft 61 and facing away from the engine block 38. The flywheel 83 also has a central aperture 85 which has a diameter slightly larger than the diameter of the second or end crankshaft portion 71 and through which the second crankshaft portion 71 extends. While other constructions can be employed, in the illustrated construction, as shown in FIG. 5, five bolts 81 are employed. More specifically, in this regard, the bolts 81 are identical and each bolt 81 includes (see FIG. 3) an enlarged head 91 engaging the upper surface 84 of the flywheel 83 and a shank portion including a non-threaded cylindrical part 95 which is snugly received in a cooperating aperture in the flywheel 83 and which has a diameter less than the diameter of the head 91, and a threaded end part 97 which, in the illustrated embodiment, has a diameter less than the diameter of the part 95 and which is received in a threaded bore 99 extending into the crankshaft first or upper portion 67 from the shoulder 77. Accordingly, tightening of the bolts 81 into the crankshaft upper portion 67 fixedly attaches the flywheel 83 to the crankshaft 61.

The flywheel 83 is located, as shown in FIG. 2, in a substantially sealed chamber 101. Various arrangements can be employed for providing the sealed chamber 101. In the disclosed construction, the sealed chamber 101 is defined, in part, by an upper engine block surface which can be the upper engine block surface 39 and by a cover 105 which is suitably fixed to the engine block 38 in sealing engagement therewith. In this last regard, a gasket (not shown) can be employed between the cover 105 and the engine block 38 and a suitable number of bolts or screws 106 (FIG. 2) can be employed to fix the cover 105 to the engine block 38. The crankshaft portion 71 projects through a suitable aperture 107 in the cover 105. A suitable seal 109 is provided between the crankshaft 61 and the cover 105 to prevent fluid flow to or from the sealed chamber 101. While other materials can be employed, the cover 105 is preferably fabricated of plastic or composite material. The resulting sealed chamber 101 provides a space from which moisture, and especially salt moisture from sea water, can be excluded and into which a fuel/lubricant mist is supplied from the uppermost of the crankcases 53 in response to pulsating crankcase pressure, and through the bearing 63 notwithstanding the usual crankcase seal (not shown) which ordinarily serves to substantially reduce pressure and fluid loss from the uppermost of the crankcases 53.

Also included in the sealed chamber 101 is means for generating an electrical potential for charging a battery (not shown). While other constructions can be employed, in the disclosed construction, such means comprises at least one first member or stator 121 which is fixedly mounted on the engine block 38 and which includes one or more coils and coil cores terminating in closely adjacent relation to a second member or armature 131 in the form of one or more magnets supported for rotation in a path adjacent the stator 121. In the illustrated embodiment, the magnets are carried by the flywheel 83. Any suitable construction for the stator 121 and armature 131 can be employed. In alternative embodiments, the flywheel 83 and attached magnets 131 can be placed inside the stator 121 with coils and coil cores facing inward.

Also located in the sealed chamber 101 is a mechanism for starting the engine 37 in response to a rotary input. In this regard, suitably mounted on the engine block 38 exteriorly of the sealed chamber 101 is a starting motor 141 (FIG. 2) which includes an output shaft 143 extending into the sealed chamber 101 to provide the rotary input referred to immediately above. In the illustrated embodiment, the shaft 143 extends into the chamber 101 through a flange 144 which is an integral part of the engine block 38 and which partially defines the upper surface 39 of the block 38. Suitable seal means 145 can be provided between the output shaft 143 and the flange 144 to prevent fluid flow into or out of the sealed chamber 101.

The engine starting mechanism is of the "Bendix" type and includes a gear 151 on the periphery of the flywheel and a pinion 153 which is movable axially of a rotatably mounted shaft 155 and into a position of driving engagement with the flywheel gear 151 in response to rotation of the shaft 155. The shaft 155 is rotated in response to rotation of the output shaft 143 via a gear 157 which is mounted on the shaft 143 and a gear 159 which meshes with the gear 157 and which is mounted on the shaft 155. Any suitable means within the sealed chamber 101 can be employed to rotatably support the shaft 155 in position to afford driving connection with the output shaft 143 of the starter motor 141 and to afford movement of the drive pinion 153 into and out of driving engagement with the flywheel gear 151. As "Bendix" type starting mechanisms are well known, no further description is believed to be necessary.

Means are provided for circulating the air and the fuel/lubricant mist in the sealed chamber 101. In this regard, as shown in FIGS. 2, 3 and 5, the flywheel 83 is provided with a series of vanes or fins 171 and a series of adjacent apertures or openings 173, which fins 171 and openings 173 function like a centrifugal fan and agitate the air and cause circulation thereof within the sealed chamber 101. Alternatively stated, the fins 171 constitute means for creating an air flow through the openings 173. The air circulation draws heated air away from the stator 121 and armature 131 and facilitates dissipation thereof to the atmosphere through the engine block 38 and cover 105 or through cooling means still to be described. Such circulation also serves to convey the fuel/lubricant mist throughout the sealed chamber 101 and aids in carrying heat away from the stator. In the illustrated embodiment, the fins 171 are formed on an annular member 175 that is secured to the upper surface 84 of the flywheel 83 by suitable means such as bolts 177 (FIG. 5).

The engine 37 also comprises means located in the chamber 101 for extracting heat from the chamber 101 by cooling the air which is circulated in the chamber 101. While various suitable means can be employed, in the illustrated embodiment, this means includes a plurality of finned water jackets 178 which are secured to the underside of the cover 105 and which are located in adjacent relation to the openings 173 in the flywheel 83. The water jackets 178 are connected via suitable supply and return conduits 179 to a supply of cooling water (not shown) and to an overboard discharge. The water jackets 178 are located relative to the openings 173 so air that is drawn upwardly through the openings 173 flows in a path adjacent the water jackets 178 and transfers heat to the water jackets 178. Thus, the fins 171 and the openings 173 constitute means for creating an air flow in a path adjacent the water jackets 178.

Carried by the cover 105 on the exterior surface thereof is a timer base 180 (FIGS. 2–4) which is suitably supported for rotation about the crankshaft axis by the cover 105, which supports one or more trigger coils 182, and which surrounds the part 71 of the crankshaft 61. The crankshaft portion 71 carries a suitable magnet or magnets 184 cooperating with the trigger coil or coils 182 to generate ignition trigger pulses.

Any suitable means can be provided for fixing the timer base to the cover 105 and affording relative rotation therebetween. In the disclosed construction, the cover 105 and the timer base include interengaging means in the form of a recess 186 (FIGS. 3 and 4) in the cover 105 and a mating part of the timer base 180 for locating the timer base 180 relative to the cover 105. A suitable number of retaining means 188 are provided to fix the timer base 180 to the cover 105 in encircling relation to the crankshaft portion 71. As is conventional, the timer base 180 can be operably connected to a suitable linkage (not shown) adapted to adjust the spark timing.

Figure 7:
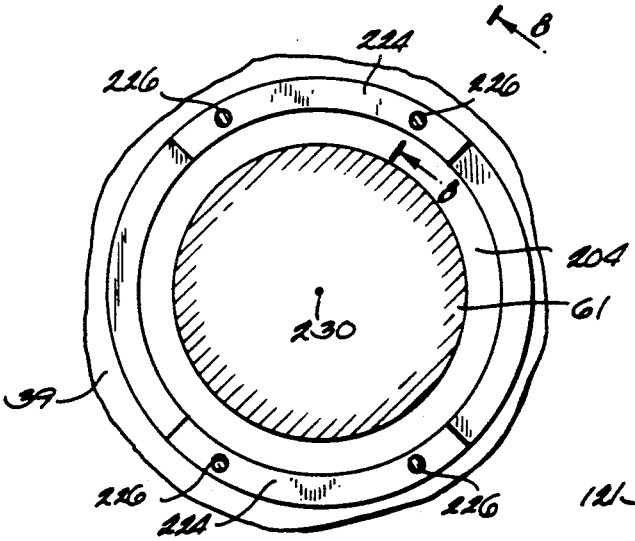
FIG. 7 is a view taken along line 7—7 in FIG. 6.
Figure 8:
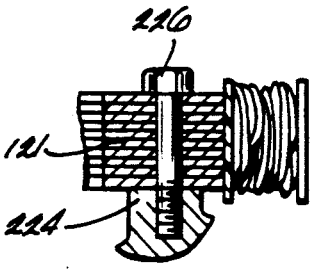
FIG. 8 is a view taken along line 8—8 in FIG. 7.

An outboard motor 200 which is an alternative embodiment of the invention is illustrated in FIGS. 6–8. Except as described hereinafter, the outboard motor 200 is substantially identical to the outboard motor 11 of the first embodiment, and common elements have been given the same reference numerals.

In the outboard motor 200, the fuel/lubricant mist is substantially eliminated from the chamber 101 by the addition of a seal 204 which surrounds the upper portion 67 of the crankshaft 61 and which is located outwardly of or above the outermost or upper crankshaft bearing 63 for sealing the chamber 101 from the crankcase 208 (shown in FIG. 6). Alternatively stated, the seal 204 seals the crankcase 208 to prevent loss of fluid to the exterior of the engine block 38. The seal 204 substantially prevents any fuel/lubricant mist that leaks past the uppermost crankcase seal 212 (FIG. 6), as described above, from entering the chamber 101. The sealed chamber 101 of the outboard motor 200 still provides a space from which moisture, and especially salt moisture from sea water, can be excluded.

The outboard motor 200 also differs from the outboard motor 11 in that the water jackets or cooling fins 178 and conduits 179 are omitted. The cooling fins 178 can be omitted when sufficient air circulation is provided by the fins 171 on the flywheel 83.

The outboard motor 200 also differs from the outboard motor 11 in that the outboard motor 200 includes pressure relief means 216 for venting the chamber 101 when the pressure therein exceeds a predetermined value. Preferably, such means 216 includes four pressure relief valves 220 (one is shown in FIG. 6) in the cover 105. The pressure relief valves 220 normally seal the chamber 101 but allow pressure to bleed off in the event of excessive pressure within the chamber 101. Such excessive pressure could result, for example, from failure of the seal 204.

The stator or stators 121 of the outboard motor 200 are mounted on a pair of arcuate bosses 224 (FIGS. 7 and 8) extending upwardly from the upper surface 39 of the engine block 38. The stator 121 can be mounted on the bosses 224 by any suitable means. Preferably, the stator 121 is mounted on the bosses 224 by bolts or screws 226. As shown in FIG. 7, each of the bosses 224 is centered on the crankshaft axis 230 and preferably defines an arc of 90°. The bosses 224 increase heat transfer from the stators 121 to the engine block 38 and thereby help to cool the stators 121.

Various of the features of the invention are set forth in the following claims.

We claim:

1. An internal combustion engine comprising an engine block including a surface, means including said engine block surface for defining a substantially sealed chamber, and pressure relief means including a movable valve member for venting said chamber when the pressure in said chamber exceeds a predetermined value, said chamber containing one of the following: a flywheel, means for generating an electrical current, a finned heat exchanger, and means for starting said engine.

2. An internal combustion engine as set forth in claim 1 and further comprising a crankshaft extending from said engine block and into said chamber, and a flywheel located in said chamber and connected to said crankshaft.

3. An internal combustion engine as set forth in claim 2 wherein said engine block at least partially defines a crankcase, and wherein said engine further comprises an outermost bearing rotatably supporting said crankshaft, and sealing means which is located outwardly of said bearing and which surrounds said crankshaft for sealing said chamber from said crankcase.

4. An internal combustion engine in accordance with claim 1 and further comprising means located in said chamber for generating an electrical current.

5. An internal combustion engine in accordance with claim 4 wherein said current generating means includes a stator located in said chamber and fixed to said engine block, and a magnet supported in said chamber for rotation in a path adjacent said stator.

6. An internal combustion engine in accordance with claim 1 and further comprising cooling means located in said chamber for extracting heat from said chamber.

7. An internal combustion engine in accordance with claim 6 wherein said cooling means includes a finned heat exchanger located in said chamber, and means for creating an air flow in a path adjacent said heat exchanger.

8. An internal combustion engine in accordance with claim 6 wherein said means for creating an air flow includes an aperture in said flywheel, and means for forcing an air flow through said aperture.

9. An internal combustion engine in accordance with claim 8 wherein said means for forcing an air flow through said aperture includes a plurality of fins extending from said flywheel.

10. An internal combustion engine in accordance with claim 9 wherein said flywheel includes an outer surface extending generally perpendicularly to said crankshaft and facing away from said engine block, and wherein said fins are located on said outer surface of said flywheel.

11. An internal combustion engine in accordance with claim 1 and further comprising means located in said chamber for starting said engine.

12. An internal combustion engine in accordance with claim 11 and further comprising a starter motor mounted on said block exteriorly of said chamber and including an output shaft extending into said chamber, and seal means on said starter output shaft for preventing fluid flow relative to said chamber while affording rotary movement of said output shaft, and wherein said engine starting means includes a starter gear located in said chamber, and a mechanism which is located in said chamber, which is drivingly connected to said output shaft and which is engageable with said starter gear in response to output shaft rotation to rotate said flywheel.

13. An internal combustion engine comprising an engine block including a outer surface, means including said engine block and a member connected to said surface of said engine block for defining a chamber, a crankshaft extending from said engine block and into said chamber, a flywheel located in said chamber, connected to said crankshaft, and having thereon a starter gear, a stator located in said chamber and fixed to said engine block, a magnet located in said chamber and fixed to said flywheel for rotation therewith in a path adjacent said stator, a starter motor mounted on said block exteriorly of said chamber and including an output shaft extending into said chamber, a mechanism located in said chamber, drivingly connected to said output shaft, and engageable with said starter gear in response to output shaft rotation to rotate said flywheel, and pressure relief means including a movable valve member for venting said chamber when the pressure in said chamber exceeds a predetermined value.

14. An internal combustion engine comprising an engine block at least partially defining a crankcase, means on said engine block for defining a substantially sealed chamber, a crankshaft extending from said engine block and into said chamber, a flywheel located in said chamber and connected to said crankshaft, an outermost bearing rotatably supporting said crankshaft, sealing means which is located outwardly of said bearing and which surrounds said crankshaft for sealing said chamber from said crankcase, and pressure relief means including a movable valve member for venting said chamber when the pressure in said chamber exceeds a predetermined value.

15. An internal combustion engine comprising an engine block including an outer surface and an integral portion partially defining said outer surface, means including said engine block and a member connected to said surface of said engine block for defining a chamber, a crankshaft extending from said engine block and into said chamber, a flywheel located in said chamber, connected to said crankshaft, and having thereon a starter gear, a stator located in said chamber and fixed to said engine block, a magnet located in said chamber and fixed to said flywheel for rotation therewith in a path adjacent said stator, a starter motor mounted on said block exteriorly of said chamber and including an output shaft extending through said engine block portion and into said chamber and a mechanism located in said chamber, drivingly connected to said output shaft, and engageable with said starter gear in response to output shaft rotation to rotate said flywheel.

16. An internal combustion engine as set forth in claim 15 wherein said engine further comprises an outermost baring rotatably supporting said crankshaft, and sealing means which is located outwardly of said bearing and which surrounds said crankshaft for sealing said chamber from said crankcase.

* * * * *

UNITED STATES PATENT AND TRADEMARK OFFICE

CERTIFICATE OF CORRECTION

PATENT NO. : 5,078,101

DATED : January 7, 1992

INVENTOR(S) : Philip A. Anderson, et al.

It is certified that error appears in the above-identified patent and that said Letters Patent is hereby corrected as shown below:

On title page, item [75], third line listing the inventors, "Ohio" should read -- Illinois --.

Column 1, line 6, "16,329" should read -- 316,329 --.

Column 5, line 19, after "flywheel" insert -- 83 --.

Claim 13, Column 8, line 12, before "chamber" insert -- substantially sealed --.

Signed and Sealed this

Twenty-fourth Day of August, 1993

Bruce Lehman

*Attest:*

BRUCE LEHMAN

*Attesting Officer*

*Commissioner of Patents and Trademarks*